US008395646B2

(12) United States Patent
Yamamoto

(10) Patent No.: US 8,395,646 B2
(45) Date of Patent: Mar. 12, 2013

(54) THERMAL PRINTER WITH ENERGY SAVE FEATURES

(75) Inventor: Tadashi Yamamoto, San Diego, CA (US)

(73) Assignee: Rohm Semiconductors USA, LLC, San Diego, CA (US)

( * ) Notice: Subject to any disclaimer, the term of this patent is extended or adjusted under 35 U.S.C. 154(b) by 92 days.

(21) Appl. No.: 13/160,499

(22) Filed: Jun. 14, 2011

(65) Prior Publication Data

US 2012/0320138 A1 Dec. 20, 2012

(51) Int. Cl.
*B41J 2/315* (2006.01)

(52) U.S. Cl. ..... 347/171

(58) Field of Classification Search ..... 347/200, 347/202–205, 207, 209–211, 56–59, 63–64, 347/171; 257/336
See application file for complete search history.

(56) References Cited

U.S. PATENT DOCUMENTS

| | | | | |
|---|---|---|---|---|
| 3,931,492 | A | 1/1976 | Takano et al. | |
| 4,262,188 | A | 4/1981 | Beach | |
| 4,797,837 | A | 1/1989 | Brooks | |
| 4,819,011 | A | 4/1989 | Yokota | |
| 5,483,274 | A | 1/1996 | Inoue et al. | |
| 5,491,505 | A * | 2/1996 | Suzuki et al. | 347/203 |
| 5,517,224 | A * | 5/1996 | Kaizu et al. | 347/59 |
| 5,567,630 | A * | 10/1996 | Matsumoto et al. | 347/59 |
| 5,677,721 | A | 10/1997 | Suzuki et al. | |
| 5,714,994 | A | 2/1998 | Suzuki et al. | |
| 6,229,557 | B1 | 5/2001 | Ooyama | |
| 6,664,992 | B1 | 12/2003 | Yokoyama et al. | |
| 7,990,405 | B2 | 8/2011 | Fukumoto | |
| 2001/0001558 | A1 | 5/2001 | Ishinaga et al. | |
| 2005/0270359 | A1 | 12/2005 | Katsuma et al. | |
| 2008/0211840 | A1 | 9/2008 | Zevin et al. | |

FOREIGN PATENT DOCUMENTS

| | | | |
|---|---|---|---|
| JP | H03-73364 | A | 3/1991 |
| JP | H04-126261 | A | 4/1992 |
| JP | 2000-025253 | A | 1/2000 |
| JP | 2001-232830 | A | 8/2001 |
| JP | 2001-270140 | A | 10/2001 |
| JP | 2004-142356 | A | 5/2004 |
| JP | 2007-144890 | A | 6/2007 |
| JP | 2007-331357 | A | 12/2007 |

OTHER PUBLICATIONS

Applicant brings the attention of the Examiner to the following pending U.S. Applications; U.S. Appl. No. 13/160,503, filed on Jun. 14, 2011 and U.S. Appl. No. 13/160,494, filed on Jun. 14, 2011.

* cited by examiner

*Primary Examiner* — Kristal Feggins
(74) *Attorney, Agent, or Firm* — Chen Yoshimura LLP

(57) ABSTRACT

A thermal printer having a thermal printhead with energy save features which is capable of high speed and high quality printing is provided. The thermal printer has an energy storage device and a thermal printhead including a substrate, a resistor layer formed on one surface of the substrate, and a thermoelectric element disposed on the other surface of the substrate opposite to where the resistor layer is formed, wherein the thermoelectric element converts heat generated by the resistor layer to electrical energy when a temperature difference between the resistor layer and an opposite side of the thermoelectric element where the resistor layer is disposed nearby becomes large enough for the thermoelectric element to convert heat into electric energy, and the electrical energy is stored in the energy storage device.

14 Claims, 11 Drawing Sheets

| Temp / Mode | $T_s<T_1$ | $T_s-T_t<T_c$ & $T_2\geq T_s\geq T_1$ | $T_s-T_t\geq T_c$ & $T_2\geq T_s\geq T_1$ | $T_s>T_2$ |
|---|---|---|---|---|
| Heating | YES | | | |
| Neutral | | YES | | |
| Conversion | | | YES | |
| Cooling | | | | YES |

FIG. 10

THERMAL PRINTER WITH ENERGY SAVE FEATURES

BACKGROUND OF THE INVENTION

1. Field of the Invention

The present invention relates to a thermal printer, and more particularly, to a thermal printer having a thermal printhead with energy save features.

2. Description of the Related Art

Thermal printing techniques have been widely used in such areas as portable/mobile, retail, gaming/lottery, and medical due to several advantages over other types of printing techniques such as inkjet, laser or ribbon. Some examples of the advantages are quiet operation, light weight due to a simple structure, no need for ink, toner, or ribbon to replace, and the like. With these advantages, thermal printers based on the thermal printing techniques are built into a variety of devices including battery operated devices which may need to operate in an extreme environment. In particular, thermal printers in such devices are likely to be subjected to a wider range of temperatures compared with other types of printers which are mainly used in offices or in a house. As thermal printers rely on heat to print images onto a thermosensitive paper, there is a need for a thermal printhead used in a thermal printer that can offer a reliable fast printing without deterioration of the printing quality even in an extreme ambient temperature. In addition to such a need, there is also a need for a thermal printer that can offer a long battery life for battery operated devices.

FIG. 1 shows a simplified cross-sectional view of a conventional thermal printhead B1. The thermal printhead B1 includes a substrate 101, a resistor layer 102, a heatsink 105, a drive IC 106 and a platen 120. In printing an image using the thermal printhead B1, a portion of the resistor layer 102 which constitutes a heating element to imprint a dot is heated by supplying electrical power. When a series of dots is to be printed, this particular portion of the resistor layer 102 is repeatedly supplied with electrical power with power on times in between power off times and the series of dots is printed onto a thermosensitive paper 121 during the power on times. If the series of dots is a long one, the temperature buildup of the resistive layer 102 may occur. Particularly, when On/Off switching speed of supplying electrical power is increased, it may become difficult for the resistive layer 102 to follow the increased switching speed because the resistor layer 102 cannot dissipate the heat fast enough due to the temperature buildup.

In contrast to forced heating of the particular portion of the resistor layer 102 by electrical power, cooling of the particular portion of the resistor layer 102 occurs by conducting heat through the substrate 101 and by dissipating the heat through the heatsink 105 to surrounding air. In other words, cooling time of the heating element of the resistor layer 102 depends on natural cooling which in turn depends on such factors as the combination of the heat capacity of the resistor layer 102, heat capacity and conductivity of the substrate 102 and the heatsink 105 and an ambient temperature of the surrounding air. If, for example, the heat capacities of the resistor layer 102 and the substrate 101 are too large to dissipate the heat in time to follow the On/Off switching speed, problems such as trailing or a blur of a printing dot may occur. Even if the heat capacities of the resistor layer 102 and the substrate 101 are small, if the heatsink 105 cannot dissipate the heat conducted by the resistor layer 102 and the substrate 101 fast enough, the same problems may occur. This extra heat which needs to be dissipated, not only causes problems in printing, but also the electrical energy used to generate the extra heat is entirely wasted from the perspective of the device power source.

SUMMARY OF THE INVENTION

In light of the above and in view of a general trend for faster printing with reduced power consumption, there exists a need for a thermal printer having a thermal printhead capable of a faster printing rate while maintaining clean and high resolution printed images that can be used in such areas as portable/mobile, retail, gaming/lottery, and medical, including such devices as a battery operated mobile device with a printer, POS, FAX, ATM, and the like.

Accordingly, the present invention is directed to a thermal printer having a thermal printhead that fulfills this need.

An object of the present invention is to provide a thermal printer capable of saving energy without sacrificing the printing rate and quality.

Additional features and advantages of the invention will be set forth in the descriptions that follow and in part will be apparent from the description, or may be learned by practice of the invention. The objectives and other advantages of the invention will be realized and attained by the structure particularly printed out in the written description and claims thereof as well as the appended drawings.

To achieve these and other advantages and in accordance with the purpose of the present invention, as embodied and broadly described, the present invention provides a thermal printer having an energy storage device and a thermal printhead including a substrate, a resistor layer formed on one surface of the substrate, and a thermoelectric element disposed on the other surface of the substrate opposite to where the resistor layer is formed, wherein the thermoelectric element converts heat generated by the resistor layer to electrical energy when a temperature difference between the resistor layer and an opposite side of the thermoelectric element where the resistor layer is disposed nearby becomes large enough for the thermoelectric element to convert heat into electric energy, and the electrical energy is stored in the energy storage device.

In another aspect, the present invention provides a thermal printer having an energy storage device and a thermal printhead including a substrate, a resistor layer formed on one surface of the substrate wherein the resister layer is partitioned into a plurality of resister layer segments, the resistor layer segment is further partitioned into a plurality of resistor portions, and the resistor portion constitutes a heating element, and a plurality of thermoelectric elements disposed on the other surface of the substrate, wherein each of the plurality of thermoelectric elements is positioned opposite to corresponding one of the plurality of resister layer segments, and converts heat generated by the corresponding resistor layer segment to electrical energy when a temperature difference between the corresponding resistor layer segment and an opposite side of corresponding one of thermoelectric elements where the corresponding one of the resistor layer segment is disposed nearby, becomes large enough for the corresponding thermoelectric element to convert heat into electric energy, and the electrical energy is stored in the energy storage device.

Many benefits are achieved by way of the present invention over conventional techniques. Certain embodiments of the present invention provides a thermal printer having a thermal printhead capable of saving energy while printing at a rate of faster than 1300 mm/sec without deterioration of the printing quality due to such factors as trailing, blur, fade, smear or the like that are more common with conventional thermal printers having a printing speed of up to 300 mm/sec.

It is to be understood that both the foregoing general description and the following detailed description are exemplary and explanatory, and are intended to provide further explanation of the invention as claimed.

BRIEF DESCRIPTION OF THE DRAWINGS

FIG. 10 is a table showing four different operating modes of a thermoelectric element according to an embodiment of the present invention.

DETAILED DESCRIPTION OF THE PREFERRED EMBODIMENTS

Figure 1:
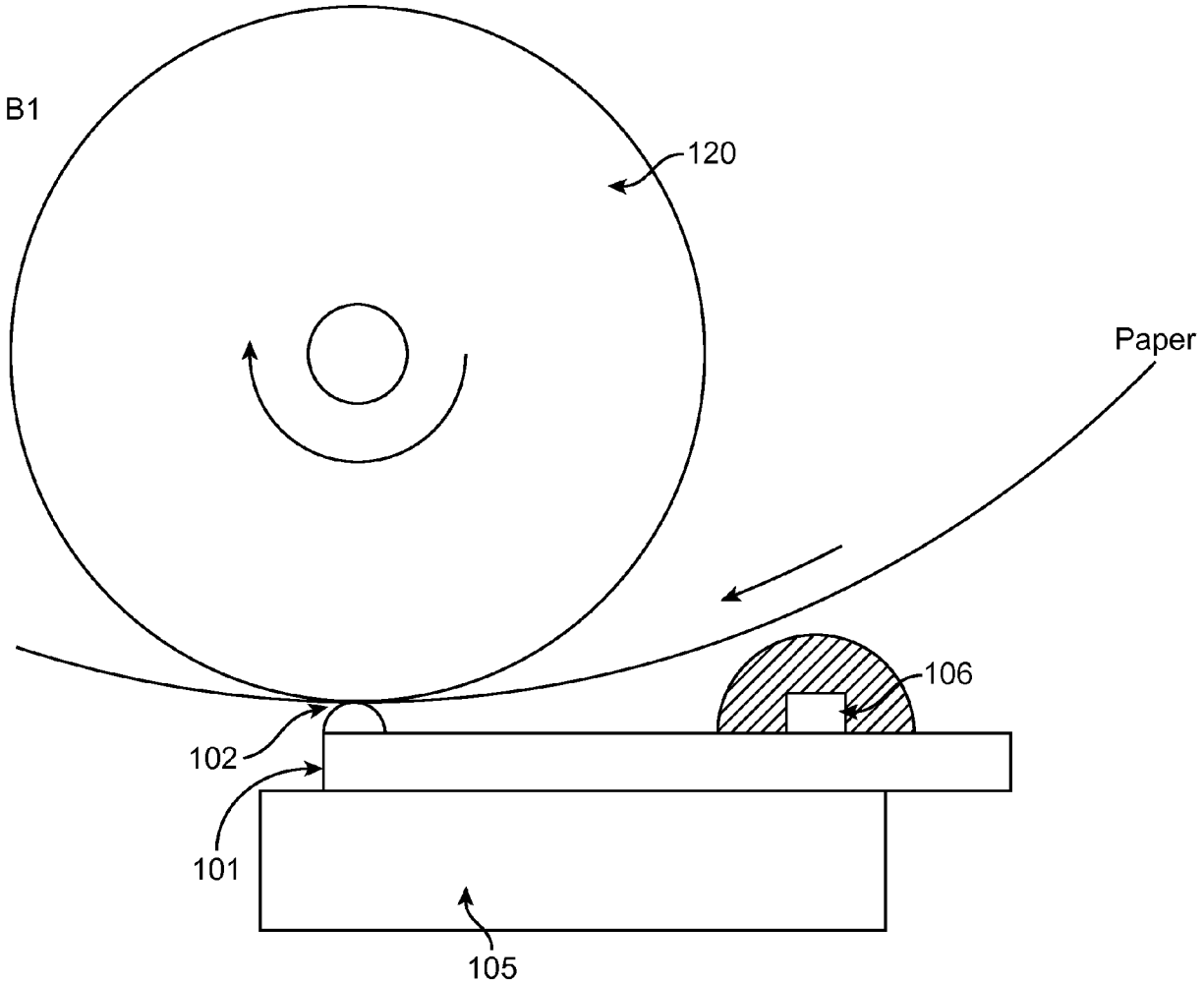
FIG. 1 is a schematic cross sectional view of a conventional thermal printer.

Embodiments of the present invention provides a thermal printer having a thermal printhead with energy save features. The thermal printer has an energy storage device and a thermal printhead including a substrate, a resistor layer, a control section, and a thermoelectric element for printing images onto a thermo sensitive paper. The energy storage device can be a battery, re-chargeable battery, capacitor or the like. The resistor layer is formed on one surface of the substrate of the thermal printhead and the thermoelectric element is formed in direct contact with the opposite surface of the substrate. The thermoelectric element can be a heat transfer device, heat pump, peltier element, thermoelectric converter or the like.

In an embodiment, if a temperature difference between the resistor layer and one side of the thermoelectric element opposite from where the resistor layer is disposed becomes large enough due to a temperature buildup of the resistor layer through repeated heating, electrical energy can be generated by the thermoelectric element because of the thermoelectric effect. This electrical energy can either be stored in an energy storage device such as a capacitor, rechargeable battery or the like, or used to supplement an operation of the thermal printer.

In certain other embodiments, the thermal printhead further includes a sensor measuring the temperature within the thermal printhead. Based on the sensed temperature by the sensor and the temperature difference between the resistor layer and the side of the thermoelectric element opposite from where the resistor layer is disposed, the control section switches the thermoelectric element into one of four modes of operation so that deterioration of the printing images due to trailing, blur, smear and the like can be alleviated without slowing down the printing rate and at the same time electrical energy may be saved as the heat due to the temperature buildup can be converted back into electrical energy. The four modes of operation include heating mode, neutral mode, conversion mode and cooling mode. In the heating mode, the thermoelectric element can generate heat using electrical energy. The thermoelectric element can also cool an object in the cooling mode. In the conversion mode, the thermoelectric element can convert heat into electrical energy. The thermoelectric element neither consumes nor generates electrical energy in the neutral mode.

During a series of printing images that requires a certain portion of the resistor layer to be heated, if the ambient temperature is so low that the temperature of the resistor layer is below a first predetermined temperature, the thermoelectric element is switched to the heating mode until the resistor layer reaches the first predetermined temperature. This is done to expedite the printing. Above the first predetermined temperature, the thermoelectric element is switched to the neutral mode where it is neither consuming nor generating any electrical energy. This mode continues until the temperature of the resistor layer becomes high enough due to, for example, printing a series of images that requires the resistor layer to be heated repeatedly with a high frequency. If the temperature is such that a temperature difference between the resistor layer and the side of the thermoelectric element opposite from where the resistor layer is disposed is large enough, electrical energy can be generated by the thermoelectric element. In such a situation, the control section is configured to switch the thermoelectric element from the neutral mode into the conversion mode and either directs this electrical energy generated to charge an energy storage device or, in case the energy storage device has enough energy already stored, directs the electrical energy to supplement an operation of the thermal printer. If the temperature buildup reaches a second predetermined temperature, the control section is configured in such a way that it switches the thermoelectric element into the cooling mode to cool the resistor layer. Based on this use of the heating, neutral, conversion and cooling modes, the thermal printer can save energy while maintaining the rate of printing without deterioration in the printing quality compared with conventional thermal printheads.

How fast the thermal printhead can print images without deterioration of the printing quality is determined mainly by the rate of cooling the resistor layer. This rate depends mostly on the combination of a heat capacity and heat conductivities of the substrate, the resistor layer formed thereon and the thermoelectric element, and the rate of heat transfer the thermoelectric element is capable of. In certain embodiments of the present invention, the heat capacity of the substrate, the resistor layer formed thereon and the thermoelectric element is minimized by use of sputtering a thin resistive film on the substrate to form the resistor layer and by having a thermoelectric element formed in direct contact with the substrate eliminating a need to have a thermal conductive member or heatsink in between. In certain other embodiments of the present invention, a plurality of thermoelectric elements is formed in direct contact with the substrate. The resistor layer is further partitioned into a plurality of resistor layer segments, and each of the plurality of resistor layer segments is further partitioned into a plurality of resistor portions. Each resistor portion constitutes a heating element for imprinting a dot onto the thermosensitive paper. Each of the plurality of resistor layer segments has a corresponding thermoelectric element so that any local temperature buildup of certain segments of the resistor layer can be dealt efficiently. By having these features, the temperature buildup of the thermal printhead can be proactively regulated and a printing speed and the quality of printing which were not possible previously with a conventional thermal printhead can be realized. At the same, electrical energy converted from the un-used heat due to the temperature buildup can be saved in an energy storage device.

Figure 2:
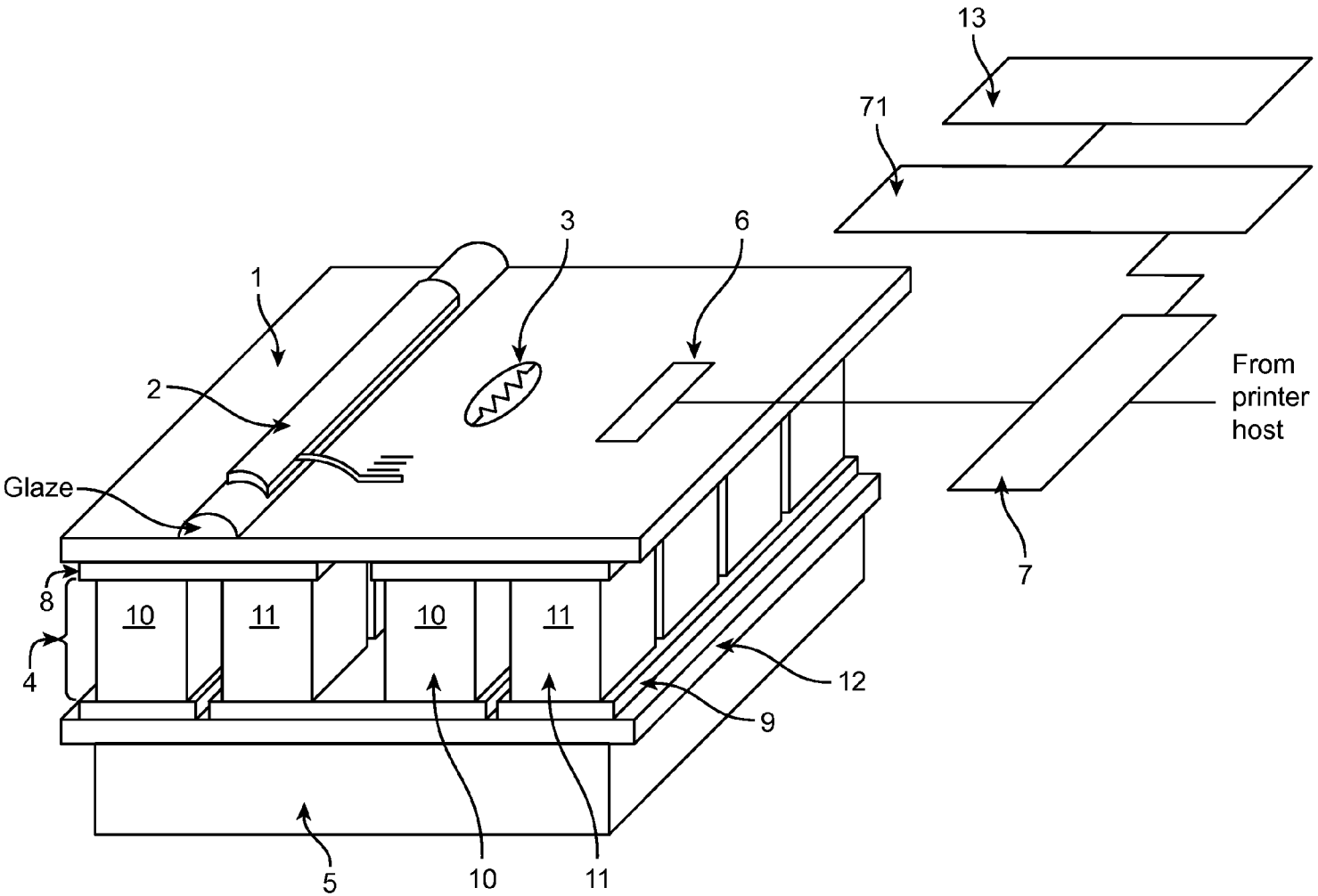
FIG. 2 is a schematic perspective view of a thermal printer having an energy storage device and a thermal printhead according to an embodiment of the present invention.

FIG. 2 illustrates an example of a thermal printer having an energy storage device and a thermal printhead according to an embodiment of the present invention. The thermal printhead includes a substrate 1, a resistor layer 2, a control section 7, a thermoelectric element 4 and a heatsink 5.

Figure 3A:
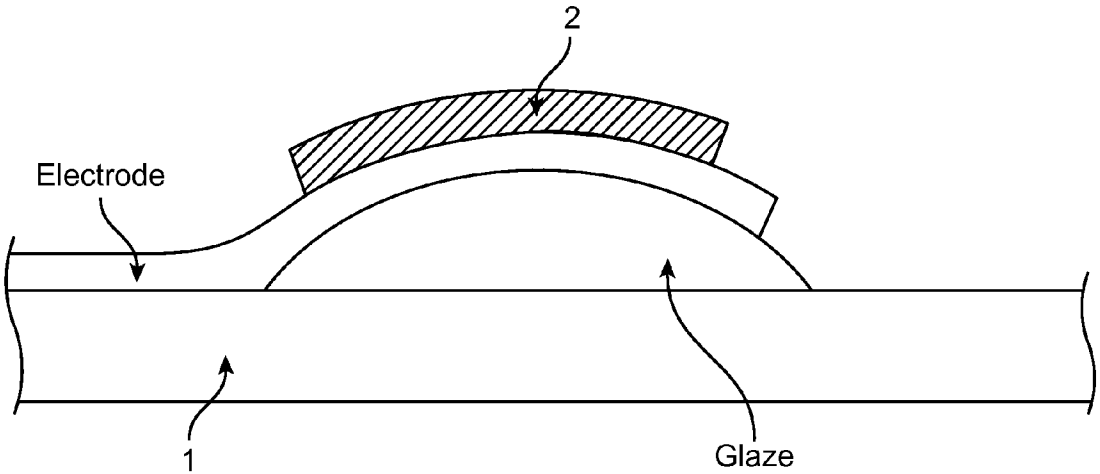
FIG. 3A is a schematic cross sectional view of a resistor layer in a thermal printhead according to an embodiment of the present invention.
Figure 3B:
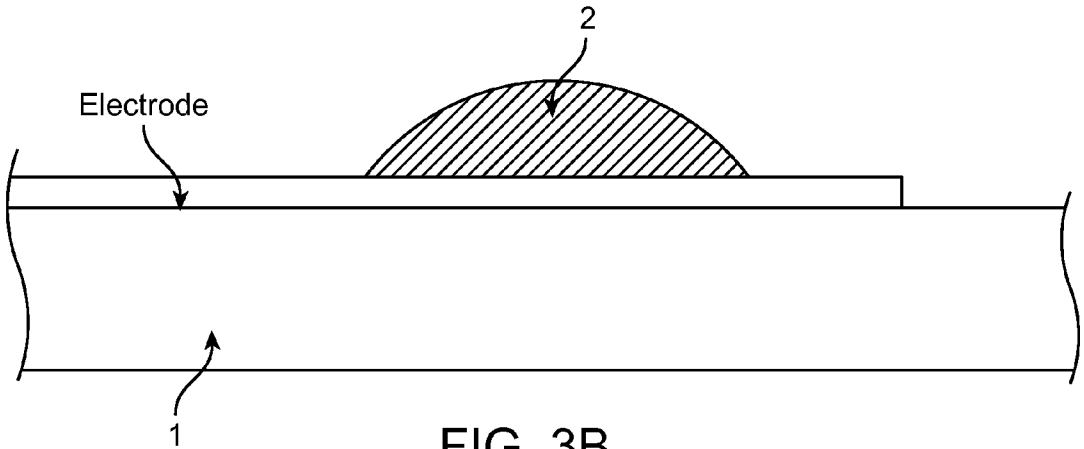
FIG. 3B is a schematic cross sectional view of a resistor layer in a thermal printhead according to another embodiment of the present invention.

FIG. 3A shows a cross sectional view of the resistor layer 2 formed on an electrode that is formed partly on a glaze and a surface of the substrate 1. The resistor layer 2 extends in the same direction as the glaze formed on the surface of the substrate 1 as better shown in FIG. 2. The substrate 1 is made of ceramic, resin, metal, glass or the like. The resistor layer 2 can be formed by sputtering a resistive material to form a thin resistive film on the glaze and a part of the electrode on the surface of the substrate 1. Using such a sputtering method, for example, a thin resistive film with a thickness of 0.05 to 0.2 μm can be formed. Other methods such as chemical vapor deposition (CVD) and the like can also be used to form a thin resistive film. The resistor layer 2 can also be formed as a thick resistor layer by screen printing an elongated resistor strip on the substrate 1. Such resistor layer may form a rounded top surface and, for example, typically have a thickness of 0.3 to 1.0 μm as show in FIG. 3B. From the perspective of a heat capacity of the resistor layer 2, a thinner resistive film may be advantageous in obtaining a smaller heat capacity of the resistor layer 2 which allows a faster rate of heating/cooling of the resistor layer 2.

In certain embodiments, one or more of sensors 3 may be disposed in the thermal printhead. The sensor 3 may be positioned, for example, in an area near the resistor layer 2 on the surface of the substrate 1. The sensor 3 may be a thermistor, thermocouple, integrated circuit or the like formed with the substrate 1. The sensor 3 may also be disposed on a metal layer that is an extension of an electrode connecting the resistor layer 2 to a drive IC 6 supplying electrical power to the resistor layer 2. Having the sensor 3 on the metal layer may allow for a faster sensing of the temperature of the area near the resistor layer 2, because the metal layer has a larger heat conductivity than ceramic, resin, glass or the like which may form the substrate 1.

Figure 4:
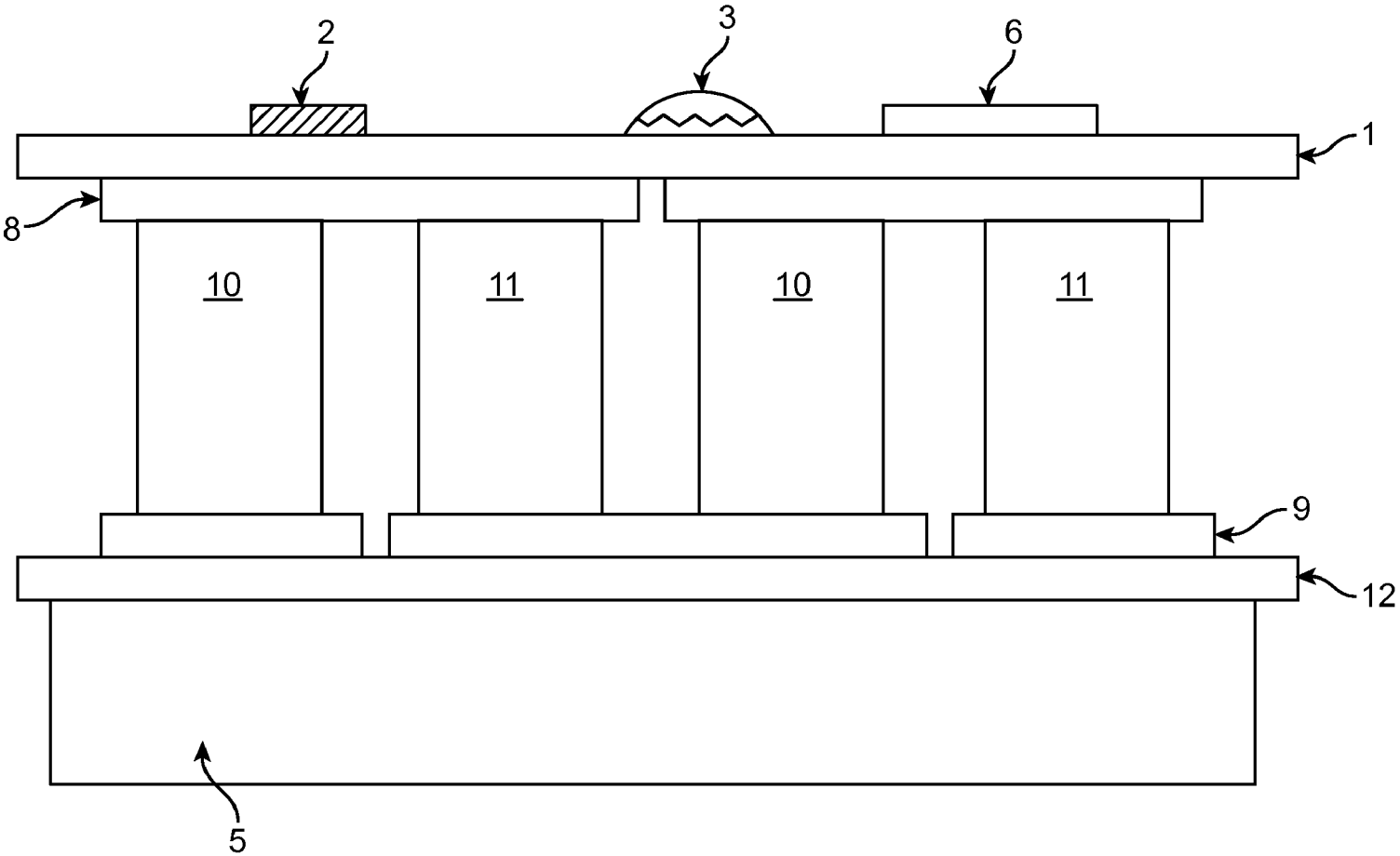
FIG. 4 is a schematic cross sectional view of a thermal printhead including a thermoelectric element according to an embodiment of the present invention.

FIG. 4 shows a schematic cross sectional view of an example of the thermoelectric element 4 formed in direct contact with the thermal printhead. The thermoelectric element 4 can be a heat transfer device, heat pump, peltier element, thermoelectric converter or the like. In FIG. 4, an example of the thermoelectric element 4 based on the peltier effect and formed in direct contact with the substrate 1 of the thermal printhead is shown.

Figure 5:
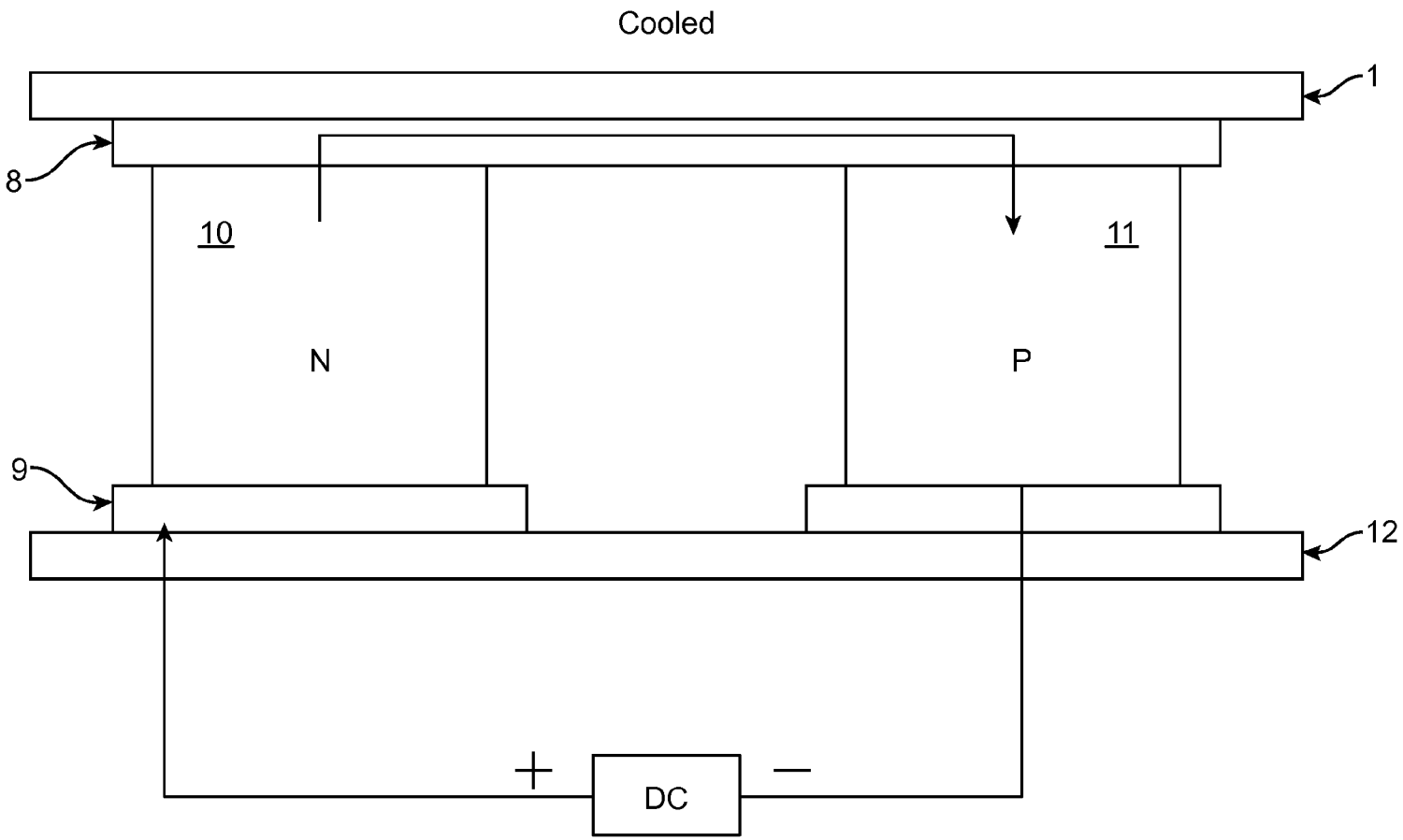
FIG. 5 is a schematic cross sectional view of a peltier element formed in a thermal printhead according to an embodiment of the present invention.
Figure 6:
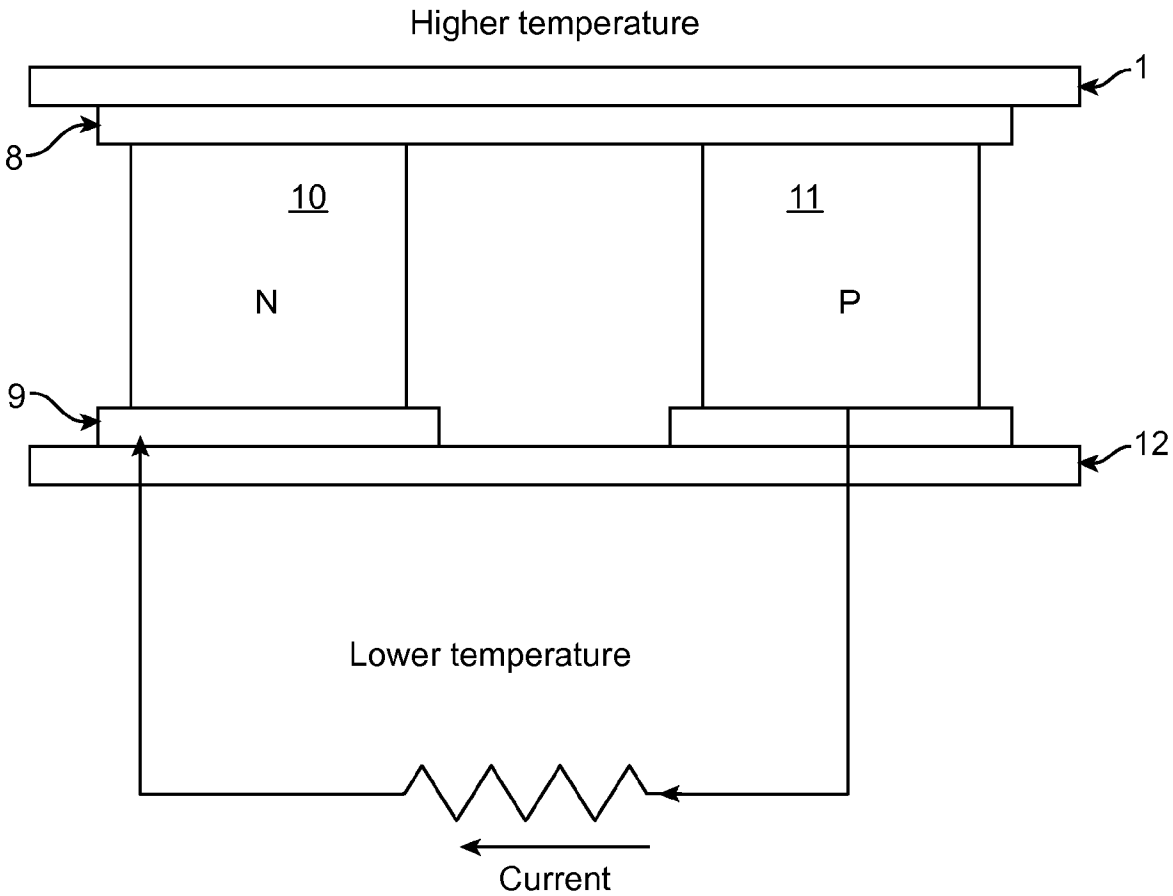
FIG. 6 is a schematic cross sectional view of a peltier element formed in a thermal printhead according to an embodiment of the present invention.

FIG. 5 shows a part of a peltier element formed in direct contact with the substrate 1 including an N type semiconductor 10 and a P type semiconductor 11. One end of the N type semiconductor 10 is connected to one side of an upper electrode 8. The other side of the upper electrode is connected to the P type semiconductor 11. The upper electrode 8 is formed in direct contact with the substrate 1. Each of the other ends of the N and P semiconductors 10-11 is connected to a corresponding lower electrode 9 formed in direct contact with a lower substrate 12. The electrodes 8 and 9 are made of a thin film of a metallic material such as gold, silver, copper, aluminum or the like having a thickness of less than 2 μm and formed by such method as printing, sputtering, depositing, plating or the like. If the positive side of a DC power supply is connected to the N type semiconductor 10 through the corresponding lower electrode 9 on the left side of FIG. 5 and the negative side of the DC power supply is connected to the P type semiconductor 11 through the corresponding lower electrode 9 on the right side of FIG. 5, a current flows through both of the semiconductors in the direction indicated in FIG. 5. The current going through the junction of two different metals formed by the N type semiconductor 10 and the electrode 8, will remove heat from the electrode 8 and the substrate 1 by electrons having thermal energy moving from the upper electrode 8 through the N type semiconductor 10 to the lower electrode 9 and the lower substrate due to the peltier effect. In a similar manner, the current going through the junction of two different metals formed by the P type semiconductor 11 and the upper electrode 8, will remove heat from the electrode 8 and the substrate 1 by holes having thermal energy moving from the electrode 8 through the P type semiconductor 11 to the lower substrate 12 due to the peltier effect. Thus, both electrons and holes of the respective semiconductors contribute to this transfer of the heat by the peltier effect. If the polarity of the DC power supply is reversed, then heat is removed from the lower substrate 12 and transferred to the substrate 1 by the peltier effect of the junction formed by the electrode and the semiconductor. The peltier element can also convert heat to electrical energy. As shown in FIG. 6, if a temperature of the substrate 1 is higher than a temperature of the lower substrate 12, this temperature difference causes both electrons and holes with thermal energy in the upper electrode 8 to diffuse to the N type semiconductor 10 and to the P type semiconductor 11 respectively removing heat from the substrate 1 through the upper electrode 8 and resulting in current flow in the direction as shown in FIG. 6. This current may be used for any purpose including operation of the thermal printhead or charging a rechargeable battery of such types as capacitor, nickel cadmium, nickel hydroxide, lithium ion, lithium polymer, or the like, for example.

In the embodiment of the present invention as shown in FIG. 4, the thermoelectric element 4 includes a plurality of upper electrodes 8, a plurality of lower electrodes 9, a first type semiconductor element 10, and a second type semiconductor element 11. This figure is merely an example that should not limit the scope of the claims. The upper electrode 8 can be formed in direct contact with the substrate 1 by printing a thin film of a metallic material such as gold, silver, copper, aluminum or the like having a thickness of less than 2 μm on one surface of the substrate 1. Alternately, the upper electrode 8 can also be formed by sputtering, depositing, plating or the like. The lower electrode 9 can also be formed from a metallic material such as gold, silver, copper, aluminum or the like by printing, sputtering, depositing, plating or the like on a surface of a lower substrate 12. Preferably, the lower substrate 12 is a substrate having a high thermal conductivity and may be attached to a heatsink 5.

As can be seen in FIG. 4, both the upper and lower electrodes 8-9 can be formed with a thin film of a metallic material providing both electrical and physical connection between the electrodes formed on the substrates and both of the first and second type semiconductors 10-11 formed thereon, while at the same time maximizing the thermal conductivity and minimizing the heat capacity of the thermal printhead. The first type semiconductor 10 is connected between one of the lower electrodes 9 and one of the upper electrodes 8 which is connected to the second type semiconductor 11 whose other end is connected to another one of the lower electrodes 9. The semiconductors 10-11 may be connected to their respective electrodes by soldering. A series of first and second type semiconductors 10-11 disposed in the manner as shown in FIG. 4 may form a peltier element. Of course, other manners of disposing the semiconductors are possible to form a peltier element. One surface of the lower substrate 12 may be attached to one side of a heatsink 5 and another side of the heatsink 5 may be attached to a casing of a thermal printer to induce a better heat dissipation. In an alternative, each of the first and second type semiconductors 10-11 can be attached to its respective upper or lower electrode 8 or 9 by utilizing a direct bonding technology or through a conductive adhesive.

Figure 7:
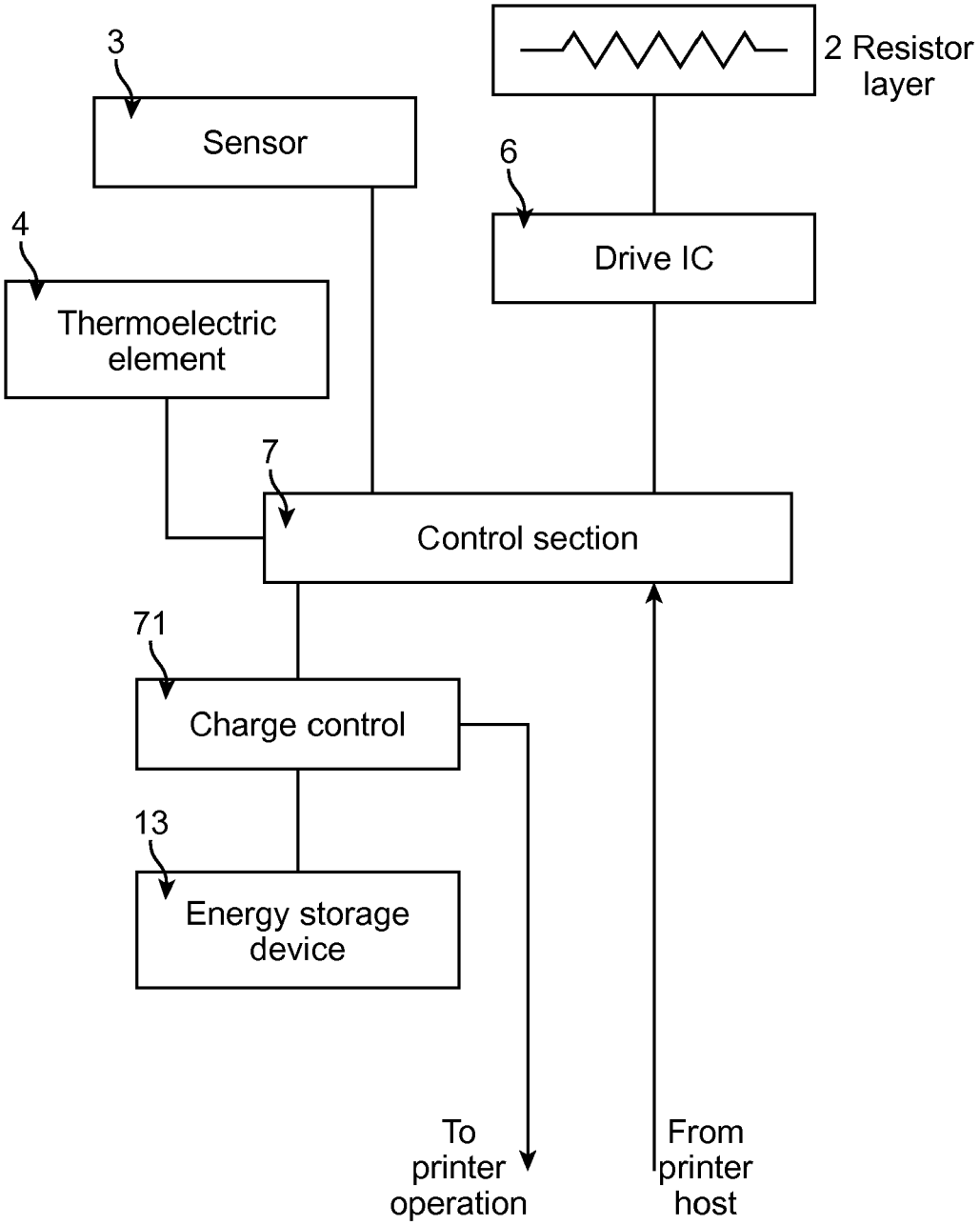
FIG. 7 is a schematic block diagram of electrical components in a thermal printer according to an embodiment of the present invention.

FIG. 7 shows a schematic block diagram of electrical components in the thermal printer. The sensor 3, the thermoelectric element 4, the drive IC 6, and a charge control 71 are connected to the control section 7 among other components. The energy storage device 13 is connected to the charge control 71, as shown in FIG. 7.

The energy storage device 13 can be any device capable of storing electrical energy. Some examples of the energy storage device 13 are a rechargeable battery of such types as nickel cadmium, nickel metal hydride, lithium ion, lithium ion polymer, capacitor, and any combination of these. Of these, lithium ion and lithium ion polymer type batteries have seen increased use particularly in portable handheld devices. The batteries of these types are light, and have high capacity, but they require specific charging procedures in order to have an efficient and yet safe usage. For example, a typical lithium ion battery may be used within a voltage range of about 3.0 to 4.2 volts. After an usage, the voltage may reach a certain low level, then a charge control can charge the battery by supplying a certain constant current depending on the capacity of the battery. For example, a lithium ion battery may be charged at a constant current equal to 100% of the current that would discharge the fully charged battery in one hour. The percentage may be varied depending on a specific type of lithium ion batteries. If 100% current is used, it would take about one hour to charge an almost depleted battery. This current goes down to almost zero around near the end of charging and this decrease in current needs to be detected by the charge control so that charging can be stopped. Any overcharging may damage the battery. Further, a trickle charge that are commonly used in nickel cadmium and nickel metal hydride batteries, must be carefully monitored for the lithium ion and lithium ion polymer type batteries in order to prevent an overcharging of the battery. The over discharge of the battery is also harmful as it may render the battery un-rechargeable. Other factors such as ambient temperature and humidity also need to be taken into consideration. Because of the nature of the current generated by the thermoelectric element 4 which might be uneven and unpredictable, it may be more beneficial to use the current to do a trickle charge for a nickel cadmium, nickel metal hydride, lithium ion or lithium ion polymer type battery, provided that the current going into and the voltage of the battery are carefully monitored to prevent over charging and discharging of the battery. Many systems and procedures for using and charging these types of batteries are proposed and available commercially. Some of them are based on a simple protection circuitry, while some are based on more sophisticated microcontroller programming. Many of them can be used to design and implement a charge control that can be used in embodiments of the present invention.

While, the lithium ion type batteries are generally well suited for hand-held portable devices, in certain embodiments of the present invention, use of a capacitor as an energy storage device may be more appropriate, because of low voltage and uneven current which may be generated by the thermoelectric element 4. If the current generated and the voltage associated with this current is not high enough, a plurality of capacitors connected in parallel can be charged by the current until a predetermined voltage is reached. The predetermined voltage can be determined considering the voltage generated by the thermoelectric element 4 and the capacity of the capacitor. The charged capacitors then can be switched to a serial connection mode so that the voltage of the serially connected capacitors is high enough to supplement an operation of the thermal printer such as retaining contents of a memory device, sustaining an operation of the printer's CPU during halt or sleep mode, or the like.

Figure 8:
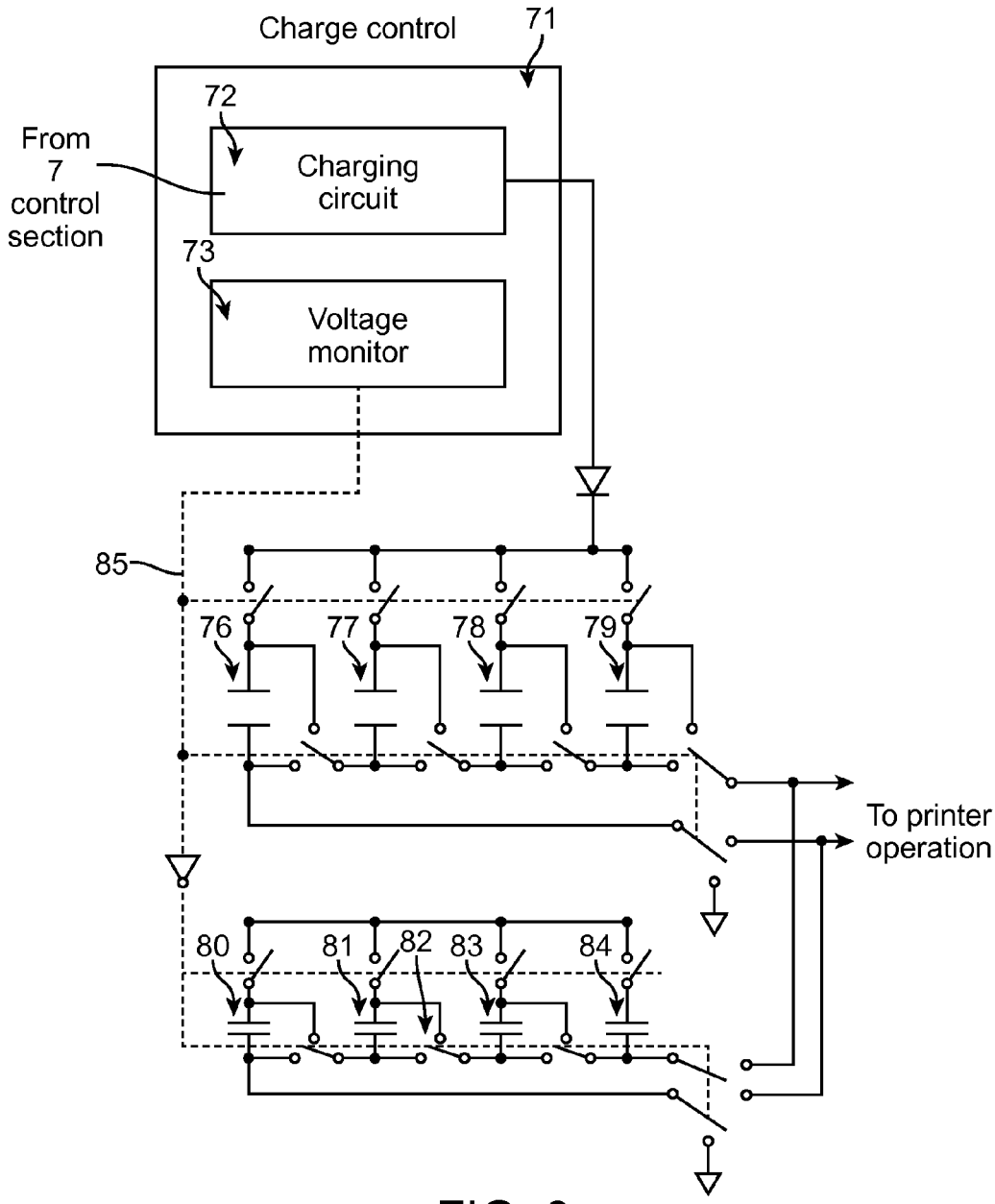
FIG. 8 is a schematic block diagram of a charge control with two sets of capacitors in a thermal printer according to another embodiment of the present invention.

FIG. 8 shows an example of a charge control 71 for charging a plurality of capacitors as an energy storage device. In this example, there are two sets of four capacitors which can be connected either in a parallel or in a serial manner by a mode control 85 generated by the charge control 71. If a first set of four capacitors are charged to a predetermine voltage level by the charge control 71, then the mode control 85 switches the first set of four capacitors into an operation mode to supplement an operation of the thermal printer. At the same time, a second set of four capacitors are switched to a charging mode by the mode control 85. The second set of four capacitors continues to be charged until the predetermined voltage level is reached. Meanwhile, the first set of four capacitors continues to supplement the operation of the printer. This way, at least one set of the capacitors are always in a charging mode. This diagram is merely an example that should not unduly limit the scope of the claims. One of ordinary skill in the art would recognize many variations, alternatives and modifications of using a capacitor as an energy storage device.

Figure 9:
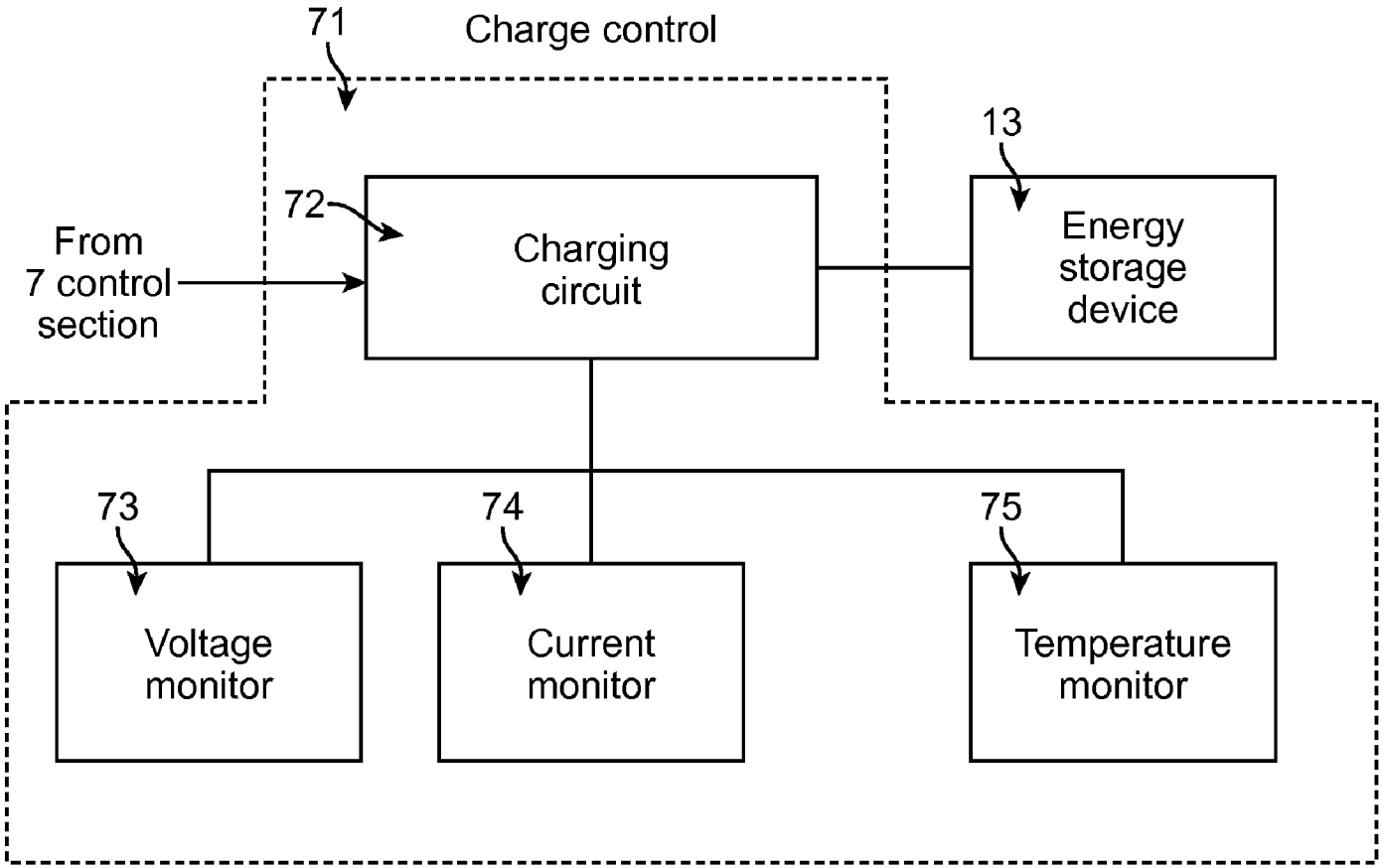
FIG. 9 is a schematic block diagram of a charge control in a thermal printer according to an embodiment of the present invention.

FIG. 9 shows another example of the charge control 71 used in the thermal printer of FIG. 2. The charge control 71 includes a charging circuit 72, a voltage monitor 73, a current monitor 74, and a temperature monitor 75. The charging circuit 72 determines whether to start or stop charging the energy storage device 13 depending on how fully charged indicate by the monitored voltage of the energy storage device 13. When the charging is started, charging current, voltage and temperature of the energy storage device 13 are periodically monitored by the respective monitors and the data obtained is fed back to the charging circuit 72 which determines the charging current as well as whether to continue or stop the charging, based on predetermined criteria. The predetermined criteria may be dependent on monitored temperature.

Referring back to FIG. 7, the drive IC 6 drives the resistor layer 2 to heat up by supplying a pulse of electrical energy to print a dot onto the thermosensitive paper. A series of dots may form an image to be printed. During printing, the control section 7 is configured to switch the thermoelectric element 4 to operate in four different modes, namely, heating mode, neutral mode, conversion mode or cooling mode, based on a sensed temperature by the sensor 3 and a temperature difference between the resistor layer 2 and the side of the thermoelectric element 4 opposite from where the resistor layer 2 is disposed.

FIG. 10 is a table showing an example of the four different modes of operation for the thermoelectric element 4, depending on the sensed temperature and the temperature difference between the resistor layer 2 and the side of the thermoelectric element 4 opposite from where the resistor layer 2 is formed. The first column of the table shows different modes of operation. The first row of the table shows four different ranges for the sensed temperature including two temperature ranges indicated by Ts−Tt<Tc & T2≧Ts≧T1, and Ts−Tt≧Tc & T2≧Ts≧T1. T1 and T2 are first and second predetermined temperatures respectively. Ts is a sensed temperature sensed by the sensor 3. Tc indicates the critical temperature difference when the thermoelectric element 4 starts generating electrical energy. Tt indicates the temperature of the side of the thermoelectric element 4 opposite to the resistor layer 2. When the sensed temperature Ts is below the first predetermined temperature T1, the control section 7 switches the thermoelectric element 4 into the heating mode. This can happen when the ambient temperature is comparatively low. The heating mode may be continued until the sensed temperature Ts reaches the first predetermined temperature T1. Once past the first predetermined temperature T1, the thermoelectric element 4 is switched into the neutral mode in which the thermoelectric element 4 is not heating, converting or cooling, rather it is in a passive mode in which electrical energy is neither consumed nor generated by the thermoelectric element 4. As the sensed temperature Ts goes up further between the first predetermined temperature T1 and a second predetermined temperature T2, a temperature difference between the resistor layer 2 and the side of the thermoelectric element 4 becomes large than the critical temperature Tc, the thermoelectric element 4 is switched into the conversion mode where heat due to the temperature buildup which is causing the temperature difference is converted to electrical energy. More specifically, this occurs when the temperature buildup is large enough to cause a temperature difference between the upper electrode 8 on the substrate 1 and the lower electrode 9 on the lower substrate 12 of the thermoelectric element 4 so that the thermoelectric element 4 can generate a current by the thermoelectric effect. When the sensed temperature Ts is above the second predetermined temperature T2, the control section 7 switches the thermoelectric element 4 into the cooling mode to cool the resistor layer 2. This ensures that the resistor layer 2 stays within the predetermined range of temperature to maintain acceptable printing speed and quality when, for example, an ambient temperature is comparatively high. The voltage supplied to the thermoelectric element 4 may be varied depending on the ambient temperature to allow for an appropriate cooling or heating.

Figure 11:
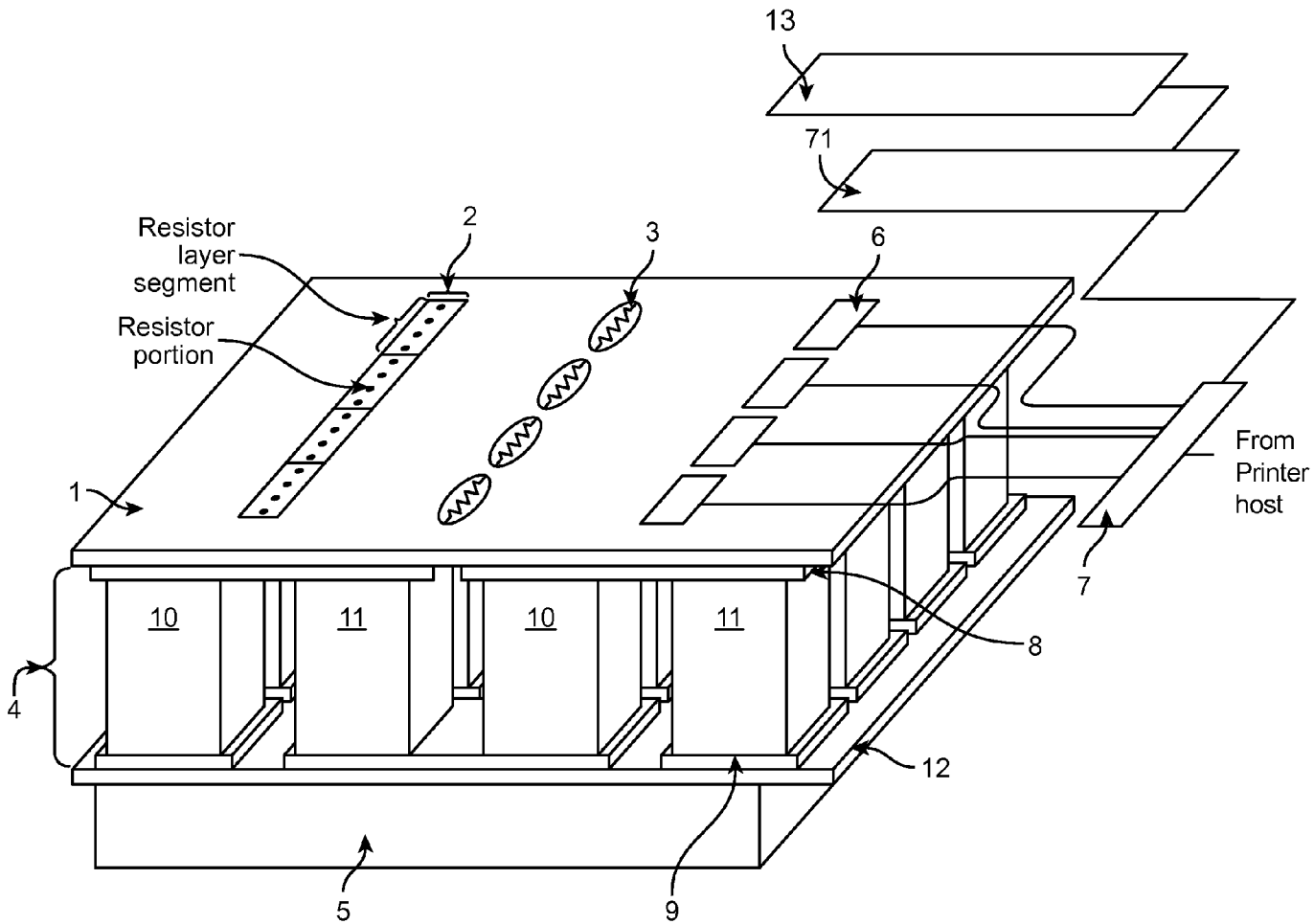
FIG. 11 is a schematic perspective view of a thermal printer according to another embodiment of the present invention.

FIG. 11 illustrates a thermal printer having an energy storage device and a thermal printhead according to another embodiment of the present invention. In this embodiment, the thermal printhead includes a plurality of thermoelectric elements 4 formed in direct contact with a substrate 1. The substrate 1 is made of ceramic, resin, metal, glass or the like. On a surface of the substrate 1, the resistor layer 2 which is partitioned into a plurality of resistor layer segments is formed. The resistor layer segment is further partitioned into a plurality of resistor portions. The resistor portion constitutes a heating element for imprinting a dot on the thermosensitive paper. The resistor layer 2 can be formed by an essentially similar process to the process for forming the resistor layer 2 of the first embodiment.

In certain embodiments, a plurality of sensors 3 is disposed on the substrate 1. Each of the plurality of sensors 3 is positioned in an area near corresponding one of the plurality of resistor layer segments of the resistor layer 2 on the surface of the substrate 1. The sensor 3 may be a thermistor, thermocouple, integrated circuit or the like formed on the surface of the substrate 1, for example. Each of the plurality of sensors 3 may be disposed on a metal layer that is an extension of an electrode connecting corresponding one of the plurality of resistor segments to a drive IC 6 supplying electrical power to the resistor layer 2. Having the sensor 3 on the metal layer may allow for a faster sensing of the temperature of the area near corresponding one of the plurality of resistor layer segments, because the metal layer has a larger heat conductivity than ceramic, resin, glass or the like which may form the substrate 1.

Each of the plurality of thermoelectric elements 4 in this embodiment is formed in direct contact with the thermal printhead in a substantially similar manner to the embodiment shown in FIG. 4. Each of the thermoelectric elements 4 includes a plurality of upper electrodes 8, a plurality of lower electrodes 9, a first type semiconductor element 10, and a second type semiconductor element 11. This figure is merely an example that should not limit the scope of the claims. In other alternatives, each of the thermoelectric elements 4 can be a heat transfer device, heat pump, thermoelectric converter or the like. The upper electrode 8 can be formed in direct contact with the substrate 1 by printing a metallic material on one surface of the substrate 1. Alternately, the upper electrode 8 can also be formed by sputtering, CVD, plating or the like. The lower electrode 9 can also be formed from a metallic material by printing, sputtering, CVD, plating or the like on a surface of a lower substrate 12. Preferably, the lower substrate 12 is a substrate having a high thermal conductivity.

Similar to the first embodiment shown in FIG. 4, both the upper and lower electrodes 8-9 can be formed with a thin film of a metallic material providing both electrical and physical connection between the substrates 1 and 12 and both first and second type semiconductors 10-11, while at the same time maximizing the thermal conductivity and minimizing the heat capacity of the thermal printhead. The first type semiconductor 10 is connected between one of the lower electrodes 9 and one of the upper electrodes 8 which is also connected to the second type semiconductor 11, whose other end is connected to another one of the lower electrodes 9. Each of the first and second type semiconductors 10-11 can be attached to its respective upper or lower electrode 8 or 9 by soldering. A series of first and second type semiconductors 10-11 disposed in the manner as shown in FIG. 4 may form a peltier element. Of course, other manners of disposing the semiconductors are possible to form a peltier element. One surface of the lower substrate 12 may be attached to one side of a heatsink 5 and another side of the heatsink 5 may be attached to a casing of a thermal printer to induce a better heat dissipation. In other alternatives, each of the first and second type semiconductors 10-11 can be attached to the respective upper and lower electrodes 8-9 by utilizing a direct bonding technology or through a conductive adhesive.

The control section 7 is configured to direct each of the plurality of thermoelectric elements 4 to operate in four different modes, namely, heating mode, neutral mode, conversion mode and cooling mode, based on a sensed temperature by corresponding one of the plurality of sensors 3, and a temperature difference between the resistor layer segment and one side of corresponding thermoelectric element 4 opposite from the resistor layer segment, in much a similar manner to what is shown in FIG. 6. In the conversion mode, the obtained electrical energy can either be used for an operation of the thermal printer or to charge the energy storage device 13 in a similar manner to the first embodiment of the present invention. When the sensed temperature is above a second predetermined temperature T2, the control section 7 switches the thermoelectric element 4 into the cooling mode to cool the resistor layer 2. This way each of the plurality of thermoelectric elements 4 keeps corresponding one of the plurality of resistor layer segments of the resistor layer 2 to stay within the predetermined range of temperature so that an acceptable printing speed and quality can be maintained, even when, for example, an ambient temperature is comparably high. The voltage supplied to the thermoelectric element 4 maybe varied depending on the ambient temperature to allow for an appropriate cooling or heating.

It will be apparent to those skilled in the art that various modification and variations can be made in the thermal printhead of the present invention without departing from the spirit or scope of the invention. Thus, it is intended that the present invention cover modifications and variations that come within the scope of the appended claims and their equivalents.

What is claimed is:

1. A thermal printer comprising:

an energy storage device; and a thermal printhead including:

a substrate;

a resistor layer formed on one surface of the substrate; and a thermoelectric element disposed on the other surface of the substrate opposite to where the resistor layer is formed, wherein the thermoelectric element converts heat generated by the resistor layer to electrical energy when a temperature difference between the resistor layer and an opposite side of the thermoelectric element where the resistor layer is disposed nearby becomes large enough for the thermoelectric element to convert heat into electric energy, and the electrical energy is stored in the energy storage device.

2. The thermal printer according to claim 1, further comprising:

a sensor disposed adjacent to the resistor layer, wherein the sensor senses the temperature of the resistor layer, and a control section configured to store the electrical energy to the energy storage device based on the sensed temperature.

3. The thermal printer according to claim 2, wherein the thermoelectric element operates in one of heating mode, neutral mode, conversion mode, and cooling mode, wherein the heating mode is used to heat the resistor layer when the sensed temperature is lower than a first predetermined temperature, the neutral mode is used when the sensed temperature is between the first and a second predetermined temperatures and the temperature difference is smaller than a critical temperature difference at which the thermoelectric element can convert heat into electrical energy, the conversion mode is used to convert heat into electrical energy and to store the electrical energy to the energy storage device when the sensed temperature is within the first and second predetermined temperatures and the temperature difference is equal to or greater than the critical temperature difference, and the cooling mode is used to cool the resistor layer when the sensed temperature is higher than the second predetermined temperature.

4. The thermal printer according to claim 3, wherein the first and second predetermined temperatures depend on an ambient temperature.

5. The thermal printer according to claim 3, wherein the electrical energy is used to supplement an operation of the thermal printer when the energy storage device reaches a predetermined energy storage level.

6. Then thermal printer according to claim 3, wherein a heatsink is attached to a side of the thermal printhead.

7. The thermal printer according to claim 1, wherein the electrical energy is used to supplement an operation of the thermal printer when the energy storage device reaches a predetermined energy storage level.

8. A thermal printer comprising:

an energy storage device; and a thermal printhead including:

a substrate;

a resistor layer formed on one surface of the substrate wherein the resister layer is partitioned into a plurality of resister layer segments, the resistor layer segment is further partitioned into a plurality of resistor portions, and the resistor portion constitutes a heating element; and a plurality of thermoelectric elements disposed on the other surface of the substrate, wherein each of the plurality of thermoelectric elements is positioned opposite to corresponding one of the plurality of resister layer segments, and converts heat generated by the corresponding resistor layer segment to electrical energy when a temperature difference between the corresponding resistor layer segment and an opposite side of corresponding one of thermoelectric elements where the corresponding one of the resistor layer segment is disposed nearby, becomes large enough for the corresponding thermoelectric element to convert heat into electric energy, and the electrical energy is stored in the energy storage device.

9. The thermal printer according to claim 8, further comprising:

a sensor disposed near each of the resistor layer segments wherein the sensor senses the temperature of corresponding resistor layer segment; and a control section configured to store the electrical energy to the energy storage device based on the sensed temperature.

10. The thermal printer according to claim 9, wherein the thermoelectric element operates in one of heating mode, neutral mode, conversion mode, or cooling mode, wherein the heating mode is used to heat the resistor layer when the sensed temperature is lower than a first predetermined temperature, the neutral mode is used when the sensed temperature is between the first and a second predetermined temperatures and the temperature difference is smaller than a critical temperature difference at which the thermoelectric element can convert heat into electrical energy, the conversion mode is used to convert heat into electrical energy and to store the electrical energy to the energy storage device when the sensed temperature is within the first and second predetermined temperatures and the temperature difference is equal to or greater than the critical temperature difference, and the cooling mode is used to cool the resistor layer when the sensed temperature is higher than the second predetermined temperature.

11. The thermal printer according to claim 10, wherein the first and second predetermined temperatures depend on an ambient temperature.

12. The thermal printer according to claim 8, wherein the electrical energy is used to supplement an operation of the thermal printer when the energy storage device reaches a predetermined energy storage level.

13. The thermal printer according to claim 10, wherein the electrical energy is used to supplement an operation of the thermal printer when the energy storage device reaches a predetermined energy storage level.

14. Then thermal printer according to claim 10, wherein a heatsink is attached to a side of the thermal printhead.

* * * * *